US005466175A

United States Patent [19]

Onoda

[11] Patent Number: 5,466,175

[45] Date of Patent: Nov. 14, 1995

[54] SHIELD CONNECTOR CONNECTING SHIELD CABLES

[75] Inventor: Katsuhiko Onoda, Shizuoka, Japan

[73] Assignee: Yazaki Corporation, Tokyo, Japan

[21] Appl. No.: 275,326

[22] Filed: Jul. 14, 1994

Related U.S. Application Data

[63] Continuation of Ser. No. 21,119, Feb. 23, 1993, abandoned.

[30] Foreign Application Priority Data

Feb. 27, 1992 [JP] Japan ..... 4-009215 U
Mar. 13, 1992 [JP] Japan ..... 4-055275

[51] Int. Cl.[6] ..... H01R 9/03

[52] U.S. Cl. ..... 439/610; 439/95

[58] Field of Search ..... 439/607, 609, 439/610, 92, 98, 108, 931, 540, 95

[56] References Cited

U.S. PATENT DOCUMENTS

| | | | |
|---|---|---|---|
| 4,169,650 | 10/1979 | Schweitzer | 439/610 |
| 4,236,779 | 12/1980 | Tang | 439/610 |
| 4,272,148 | 6/1981 | Knack, Jr. | 439/610 |
| 4,337,989 | 7/1982 | Asick et al. | 439/609 |
| 4,415,223 | 11/1983 | Asick | 439/610 |
| 4,453,798 | 6/1984 | Asick et al. | 439/610 |
| 4,508,414 | 4/1985 | Kusui et al. | 439/610 |
| 4,602,830 | 7/1986 | Lockard | 439/108 |
| 4,602,831 | 7/1986 | Lockard | 439/108 |
| 4,780,090 | 10/1988 | Sugiyama et al. | 439/540 |
| 4,886,464 | 12/1989 | Zetena, Jr. | 439/98 |
| 5,123,853 | 6/1992 | Gilbert et al. | 439/98 |
| 5,194,020 | 3/1993 | Voetz | 439/540 |

FOREIGN PATENT DOCUMENTS

| | | | |
|---|---|---|---|
| 0090539 | 10/1983 | European Pat. Off. | 439/610 |
| 0012477 | 1/1989 | Japan | 439/610 |

*Primary Examiner*—Larry I. Schwartz
*Assistant Examiner*—Hien D. Vu
*Attorney, Agent, or Firm*—Sughrue, Mion, Zinn, Macpeak & Seas

[57] ABSTRACT

A shield connector connecting a shield cable covering a plurality of sheathed cables and unsheathed conductors with an outer sheath, is provided with first and second terminals for a signal transmission and earthing, upper and lower outer housing halves conducting electrically, and a shield connecting member held between both the outer housing halves, wherein the shield connecting member has engagement portions for holding the outer sheath, holding the sheathed cables and unsheathed conductors, and fixing on the lower outer housing half. In addition, according to other aspect of the present invention, a shield connector is provided with first and second terminals, an inner housing for receiving both the terminals therein, a first outer housing for receiving the inner housing, and a second outer housing for receiving a plurality of the inner housings and engaging with a plurality of the first outer housings.

13 Claims, 4 Drawing Sheets

SHIELD CONNECTOR CONNECTING SHIELD CABLES

This is a Continuation of application Ser. No. 08/021,119 filed Feb. 23. 1993, now abandoned.

BACKGROUND OF THE INVENTION

The present invention relates generally to a shield connector which assures that shieldability of the shield connector is improved by setting many grounding contact points. More particularly, the present invention relates to improvement of a shield connector of the foregoing type having a structure for connecting a shield cable to a shield connector housing via a shield connecting member.

To facilitate understanding of the present invention, two typical conventional shield connectors will be described below with reference to FIG. 5 and FIG. 6.

FIG. 5 is a perspective view of a conventional shield connector having a structure for connecting a shield cable to a shield connector housing, particularly illustrating essential components for the shield connector in the disassembled state.

In the drawing, reference numeral 70 designates a shield connector housing, reference numeral 71 designates a shield cable to be connected to the shield connector housing 70, reference numeral 72 designates an upper shield connector housing half made of an electric conductive material to cover the shield connector housing 70 and the base end of the shield cable 71 therewith, and reference numeral 73 designates a lower shield connector housing half to be connected to the upper shield connector housing half 72 as an opponent member.

The shield cable 71 consists of a plurality of sheathed cables 74 to be electrically connected to terminals (not shown) in the shield connector housing 70, a netting shield 75 surrounding all the sheathed cables 74, and an outer shield 76 made of an electric insulative material to surround the netting shield 75. A foremost end part 75*a* of the netting shield 75 is rearwardly folded onto the outer sheath 76. The lower shield connector housing half 73 provides a receiving portion 77 made of an electric conductive material to receive the folded part 75*a* of the netting shield 75, and the shield cable 71 is connected to the lower shield connector housing half 73 by fixedly holding the folded part 75*a* at the receiving portion 77 in cooperation with an engagement fitting portion 78.

FIG. 6 is a perspective view of another conventional shield connector disclosed by Unexamined Japanese Utility Model Application (OPI) No. Sho. 60-19159, particularly illustrating essential components for the conventional shield connector in the disassembled state.

The shield connector designated by reference numeral 81 provides as essential components a connector housing 82 and covers 83 and 84 each made of a metallic material and located opposite to each other outside of the connector housing 82, and electrical shielding is achieved with the shield connector 81 by fitting both the covers 83 and 84 to each other to bring one of them in contact with the other.

A contact projection 86 is formed on a connecting portion 85 of the cover 84, while an elastic contact portion 88 is formed on a connecting portion 87 of the cover 83 to cooperate with the contact projection 86 in order to improve connectability between both the covers 83 and 84. A shield cable 89 connected to the shield connector 81 is grounded by rearwardly folding a netting portion 90 of the shield cable 89 and then fixedly securing the folded netting portion 90 to the cover 84 by fastening a pair of fitting portions 91 to each other by tightening screws 92.

However, with the conventional shield connector constructed as shown in FIG. 5, when the shield cable 71 is forcibly pulled in the rearward direction as represented by an arrow mark E after the shield connector is assembled, there often arises a problem that the folded part 75*a* of the netting shield 75 is dislocated away from the receiving portion 77 of the lower shield connector housing half 73, resulting in the electrically connected state being lost. Another problem is that the folding operation performed for the foremost end part of the netting shield 75 is troublesome and time-consuming.

In addition, with the conventional shield connector constructed as shown in FIG. 6, since electrical connecting is achieved merely by bringing both the connecting portions 85 and 87 on both the covers 83 and 84 in contact with each other, and moreover, a pair of fitting portions 91 fastened to each other by tightening the screws 92 are readily loosened, there arise problems that spring properties of the elastic contact portion 88 are degraded and an grounding capability of the shield connector can not satisfactorily be maintained for a long time.

SUMMARY OF THE INVENTION

The present invention has been made in consideration of the problems inherent to the conventional shield connector as mentioned above.

An object of the present invention is to provide a shield connector which assures that there does no arise a malfunction that the electrically connected state of the shield connector is lost or broken when a shield cable is forcibly pulled.

Another object of the present invention is to provide a shield connector having an improved structure wherein electrical shielding can easily be achieved with the shield connector.

Further object of the present invention is to provide a shield connector which assures that an earthing capability of the shield connector is sufficiently improved and an excellent shielding effect can satisfactorily be achieved with the shield connector.

According to one aspect of the present invention, there is provided a shield connector wherein a plurality of sheathed cables each serving for the purpose of signal transmission and a plurality of unsheathed conductors each serving for the purpose of earthing are covered with an outer sheath and the unsheathed conductors are connected to a shield connector, wherein the shield connector is characterized in that it provides as essential components a pair of first binding pieces for firmly holding the sheathed cables and the unsheathed conductors by binding, a pair of second binding pieces for firmly holding a shield cable via an outer sheath by binding, and a shield connecting member having an engagement portion thereof brought in engagement with engagement portions thereof of the connector housing, the shield connecting member being secured to the connector housing by fastening both connector housing halves to each other by tightening bolts.

In addition, according to other aspect of the present invention, there is provided a shield connector which is characterized in that it provides as essential components a plurality of first terminals connected to sheathed cables in a shield cable to serve for the purpose of signal transmission, a plurality of second terminals connected to unsheathed conductors in the shield cable to serve for the purpose of earthing, an inner housing for receiving the first and second terminals therein, a first electrical conductive outer housing having a shield connecting member firmly secured thereto by fastening both outer housing halves to each other by tightening bolts while receiving the inner housing, a second electrical conductive outer housing adapted to be fitted onto the first electrical conductive outer housing, an electrical conductive resilient locking member disposed between the first and second electrical conductive outer housings, and an earthing member adapted to be fitted into the second electrical conductive outer housing, the earthing member having contact portions projected therefrom corresponding to the second terminals.

With the shield connector constructed according to one aspect of the present invention, the unsheathed conductors in the shield cable are firmly held by the first binding pieces of the shield connecting member by binding. The engagement portions of the shield connecting member are brought in engagement with an engagement portion of the shield connector housing so as to allow the shield connecting member to be firmly held in the shield connector housing, and the unsheathed conductors are connected to the shield connector housing via terminals connected thereto. Since the shield cable is firmly held by the second binding pieces of the shield connecting member via the outer sheath by binding, and moreover, the engagement portion of the shield connecting member are brought in engagement with the engagement portion of the connector housing, the unsheathed conductors are firmly held by the first binding pieces while reliably maintaining the connected state therebetween, even though a high intensity of pulling force is exerted on the shield cable in the rearward direction.

Further, with the shield connector constructed according to other aspect of the present invention, simultaneous earthing is achieved via three routes. Specifically, the three routes are composed of a first route extending from the unsheathed conductors to an earthing member via a shield connecting member, a second route extending from the shield connecting member to the earthing member via the first outer housing and the resilient locking member and a third route extending from the first outer housing to the earthing member via the earthing member. Thus, the shield connector achieves an excellent shielding property by achieving the simultaneous earthing with the aid of many contact points.

Other objects, features and advantages of the present invention will become apparent from reading of the following description which has been made in conjunction of the accompanying drawings.

BRIEF DESCRIPTION OF THE DRAWINGS

The present invention is illustrated in the following drawings in which.

DETAILED DESCRIPTION OF THE PREFERRED EMBODIMENTS

The present invention will now be described in detail hereinafter with reference to the accompanying drawings which illustrate preferred embodiments thereof.

First, a shield connector constructed in accordance with a first embodiment of the present invention will be described below with reference to FIG. 1 and FIG. 2.

Figure 1:
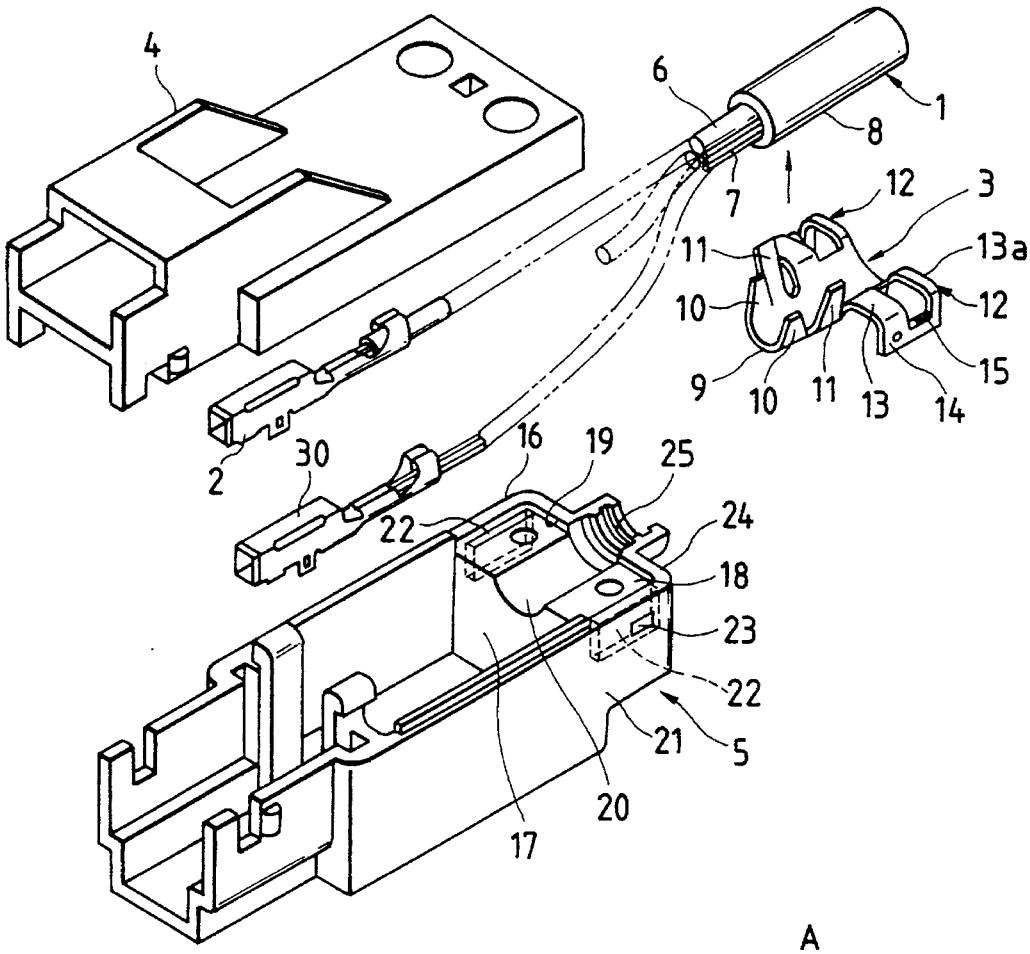
FIG. 1 is a perspective view of a shield connector in accordance with a first embodiment of the present invention, particularly illustrating essential components for the shield connector in the disassembled state.

In FIG. 1, reference numeral 1 designates a shield cable. A plurality of terminals 2 (omitted by showing a terminal 2 as shown in FIG. 1) and an grounding terminal 30 are secured to the shield cable 1. Reference numeral 3 designates a shield connecting member connecting to the shield cable 1 by binding, reference numeral 4 designates an upper male outer housing half, and reference numeral 5 designates a lower male outer housing half for firmly holding the shield connecting member 3 at the rear part in cooperation with the upper male outer housing half 4 by tightening bolts (not shown). In addition, a member (not shown) for receiving the terminals 2 therein is attached to the forward portion of the lower male outer housing half 5.

The shield cable 1 is constructed such that a plurality of sheathed cables 6 having the terminals 2 connected thereto for the purpose of signal transmission and a plurality of unsheathed conductors 7 each serving for the purpose of grounding are covered with an outer sheath 8 molded of an electrical insulative material. The shield connecting member 3 is fixedly secured to the outer sheath 8 while it is electrically connected to the unsheathed conductors 7, as if the shield cable 1 is placed on the shield connecting member 3. Further, a plurality of the unsheathed conductors 7 are fixedly connected to the grounding terminal 30 by binding. In this embodiment, the grounding terminal 30 is the same shape as the terminal 2.

Specifically, the shield connecting member 3 includes a pair of binding pieces 10 located at the forward portion of a substantially U-shaped bent bottom plate 9, a pair of binding pieces located at the intermediate portion of the bottom plate 9 and a pair of transversely extending engagement portions 12 located at the rear portion of the bottom plate. The binding pieces 10 are designed to be crimped toward each other for firmly holding the sheathed cables 6 and the unsheathed conductors 7 the binding pieces 11 are also designed to be crimped toward each other for firmly holding the outer sheath 8, and the engagement portion 12 are designed to engage lower male outer housing half 5.

Each engagement portion 12 provides a stabilizing plate 13 projecting from the bottom plate 9 in the horizontal direction, an inserting plate 14 extending from the outermost end the stabilizing plate 13 in the downward direction, and an engagement piece 15 extending from the inserting plate 14 in the outward direction. One binding piece 10 is positionally offset from the opponent binding piece 10 as seen in the axial direction. In contrast with the binding pieces 10, the binding pieces 11 are correctly located opposite to each other and have a length slightly longer than the binding pieces 10.

Figure 2:
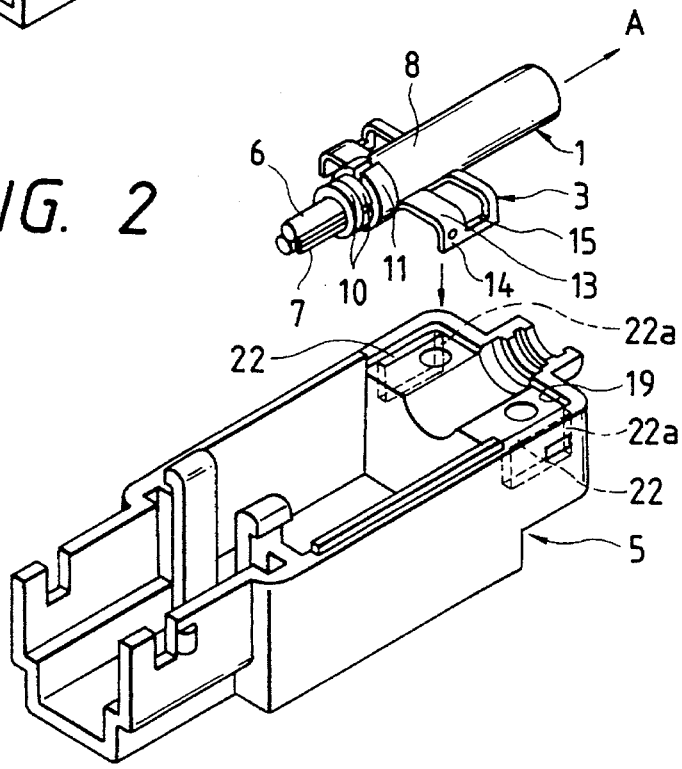
FIG. 2 is a fragmentary perspective view of the shield connector shown in FIG. 1, particularly illustrating that essential components are received and assembled in a lower shield connector housing half.

As shown in FIG. 2, the sheathed cables 6 and unsheathed conductors 7 in the shield cables 1 are firmly held by bending the binding pieces 10, while the outer sheath 8 of the shield cable 1 is also firmly held by bending the binding pieces 11.

The upper and lower male outer housing halves 4 and 5 are molded of a synthetic resin and their entire surfaces are electrically conductive as a result of an electrical conductive plating process or the like. It should be added that the lower male outer housing half 5 provides a mounting portion at the end thereof for receiving and holding the shield connector member 3.

The lower male outer housing half 5 has a block portion 17 integrated therewith at the rear end part to serve as a mounting portion, and an upper surface of the block portion 17 is located slightly lower than an upper end surface 16 of the lower male outer housing half 5 to serve as a mounting portion 18 for the stabilizing plates 13 of the shield connecting member 3. In addition, a stepped part 19 having a height substantially equal to a thickness of the shield connecting member 3 is formed between the mounting portion 18 and the upper surface 16 of the block portion 17, a mounting groove 20 having an arc-shaped sectional contour is formed at the upper central part of the block portion 17 corresponding to the bottom plate 9 of the shield connecting member 3, a pair of engagement grooves 22 are formed on the opposite sides of the block portion 17 along a side wall 21 of the lower male outer housing half 5 corresponding to the insert plates 14 of the shield connecting member 3, and a pair of engagement holes 23 are formed through the side wall 15 corresponding to the engagement pieces 15 of the shield connecting member 3. A part of the stepped part 19 between the block portion 17 and a rear wall 24 of the lower male outer housing half 5 serves as an engaging surface corresponding to rear ends 13a of the stabilizing plates 13. Further, a cable insert portion 25 is formed behind the mounting groove 20 on the rear wall 24 side of the lower male outer housing half 5.

When the insert plates 14 of the shield connecting member 3 are inserted into the engagement grooves 22, the engagement pieces 15 are brought in engagement with engagement holes 23 formed through both the side walls of the lower male outer housing half 5, and at the same time, the rear ends 13*a* of the stabilizing plates 13 come in contact with the stepped part 19 serving as an engaging surface, whereby the shield connecting member 3 is immovably received and held on the lower male outer housing half 5 not only in the upward and downward directions but also in the forward and rearward directions. Finally, the upper male outer housing half 4 is placed on the lower male outer housing half 5 and both the halves 4 and 5 are then fastened to each other by tightening bolts (not shown).

With this construction, when the shield cable 1 is forcibly pulled in the rearward direction, i.e., in the A arrow marked-direction as seen in FIG. 2, there does not arise a malfunction that the shield cable 1 is dislocated in the rearward direction, resulting in the electrical contact state between the unsheathed conductors 7 and the binding pieces 10 being lost or broken, because the shield cable 1 is immovably held by bending the binding pieces 11, and moreover, the stabilizing plates 13 and the insert plates 14 each serving as an engagement portion are engaged with rear ends 22*a* of the engagement grooves 22, and the stepped part 19 serves also as an engagement portion. It is recommendable for the viewpoint of practical use that the engagement pieces 15 can come in contact with the rear ends of the engagement holes 23 when the stabilizing plates 13 are placed on the mounting portions 18 and the insert plate 14 are inserted into the engagement grooves 22.

Figure 3:
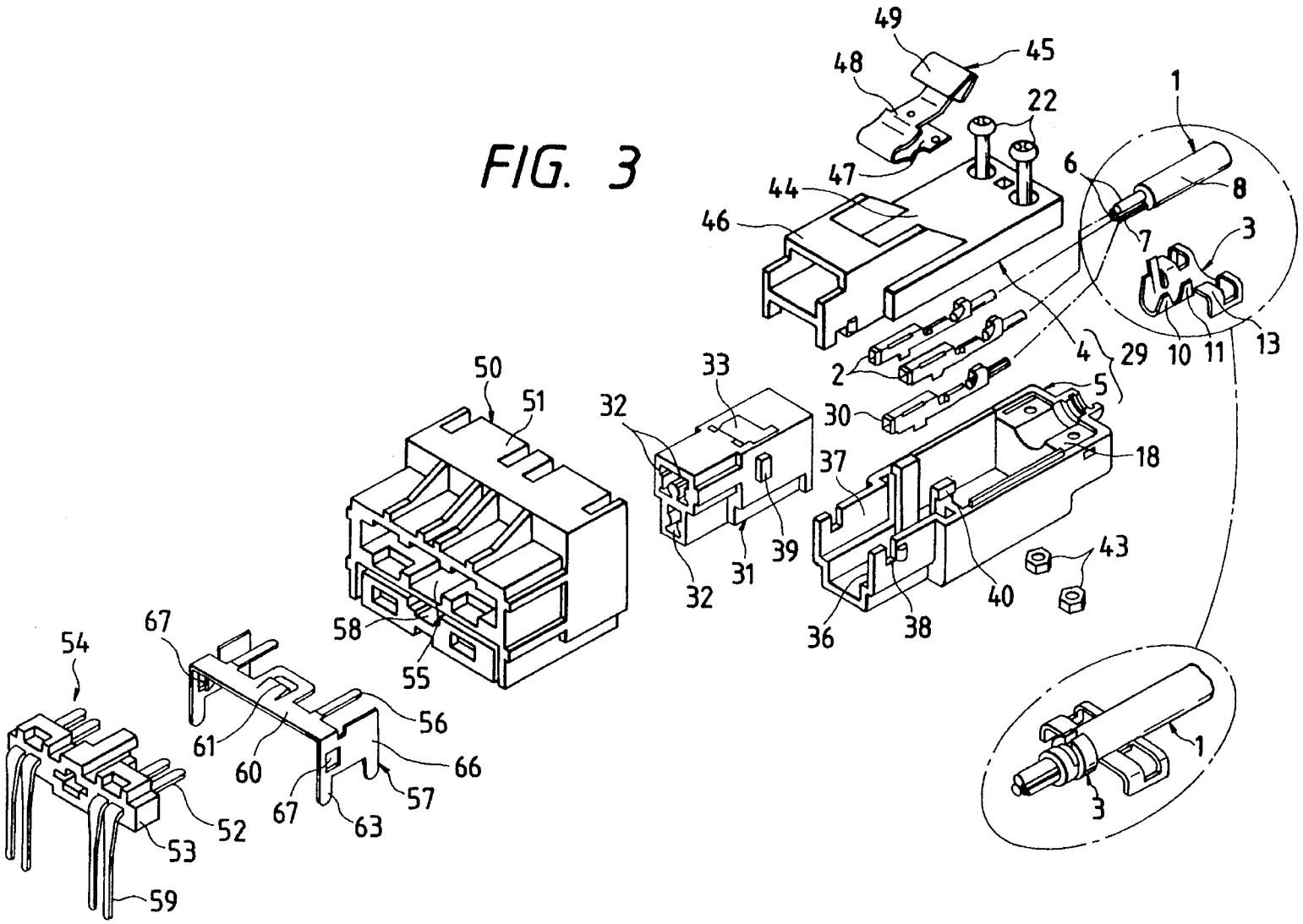
FIG. 3 is a perspective view of a shield connector in accordance with a second embodiment of the present invention, particularly showing essential components for the shield connector in the disassembled state.

Next, a shield connector constructed in accordance with a second embodiment of the present invention will be described below with reference to FIG. 3 and FIG. 4.

The terminals 2 are inserted into an upper terminal receiving chamber 32*a* of an inner housing 31 molded of an electrical insulative material, while the grounding terminal 30 is inserted into a lower terminal receiving chamber 32*b* of the same. Both the terminals 2 and 30 are locked by a locking spacer (not shown) which is inserted through an upper opening portion 33 formed on the inner housing 31.

A male outer housing 29 (i.e., first outer housing) is provided with an upper male outer housing half 4 and a lower male outer housing half 5 and divided into the two halves. The male outer housing 29 is molded of a synthetic resin and completely plated with an electrical conductive material. The lower male outer housing half 5 provides a mounting portion 18 for a shield connecting member 3 at the rear end part and a receiving portion 37 having an opening portion 36 formed at the fore end part thereof corresponding to the inner housing 31. In FIG. 3, reference numeral 38 designates a guide groove which is formed corresponding to a side projection 39 on the inner housing 31, and reference numeral 40 designates an engagement projection which is formed corresponding to the upper male outer housing half 4.

The upper male outer housing half 4 is fastened to the lower male housing half 5 by tightening bolts 42 and nuts 43. At this time, stabilizing plates 13 of the shield connecting member 3 are brought in close contact with the upper male outer housing half 4. The upper male outer housing half 5 provides a ceiling plate 44 which merges to a rectangular hollow fitting portion 46.

A V-shaped resilient locking member 45 consists of a base plate 47 and a resilient contact portion 48 both of which are integrated with each other to serve as a spring member, and a V-shaped actuating piece 49 is attached to the contact portion 48. The resilient locking member 45 is fitted into the fitting portion 46 in such a manner that the base plate 47 is placed on a ceiling plate 44 of the upper male outer housing half 4 and the contact portion 48 is then brought in contact with an upper wall 51 of a female outer housing 50 (or second outer housing).

The female outer housing 50 is molded of a synthetic resin and the whole surface of the female outer housing 50 is electrically plated in the same manner as the male outer housing 29 so as to allow the female outer housing 50 to become electrically conductive. As shown in FIG. 3, the male outer housing 29 each having an inner housing 31 received therein can be fitted into the female outer housing 50.

A molded terminal member 54 has signal transmission tab terminals 52 integrally molded of a synthetic resin 53 to cooperate with the terminals 2 in the inner housing 31. An insert opening portion 55 for inserting the molded terminal member 54 is formed at the rear part of the female outer housing 50. A ground member 57 is made of an electrical conductive metallic material, and provides tab-shaped contact projections 56 to engage with the grounding terminal 30. An insert opening portion 58 for inserting the earthing member 57 is formed below the insert opening portion 55 at the rear part of the female outer housing 50.

Base end parts 59 of the signal transmission tab terminals 52 of the molded terminal member 54 are soldered to a circuit board (not shown). The grounding member 57 is formed by punching an electrical conductive metallic plate to a predetermined contour and then bending it. The grounding member 57 provides a horizontal plate portion 61, from which tab-shaped contact projections 56 and resilient contact pieces 61 adapted to cooperate with the female outer housing 50 are projected in the direction toward the female outer housing 50. In addition, the grounding member 57 provides vertical plate portions 66 on the opposite sides thereof, and a flexible engagement piece 67 adapted to be engaged with the female outer housing 50 and tab-shaped connecting portions 63 adapted to cooperate with an grounding base board 62 made of an electrical conductive metallic material (see FIG. 4) are formed on each vertical plate portion 66.

Figure 4:
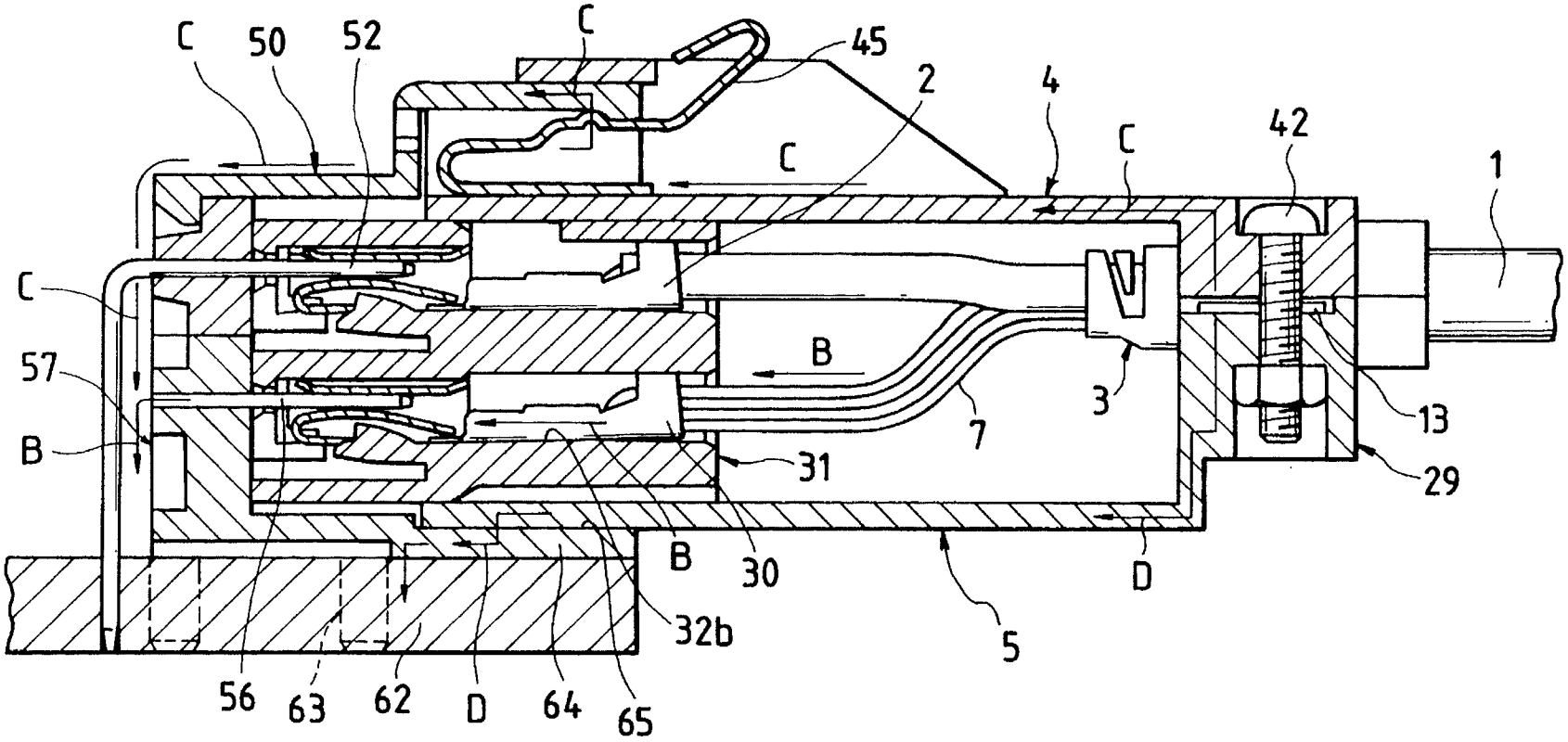
FIG. 4 is a vertical sectional view of the shield connector shown in FIG. 3, particularly illustrating that essential components for the shield connector are assembled together.
Figure 5:
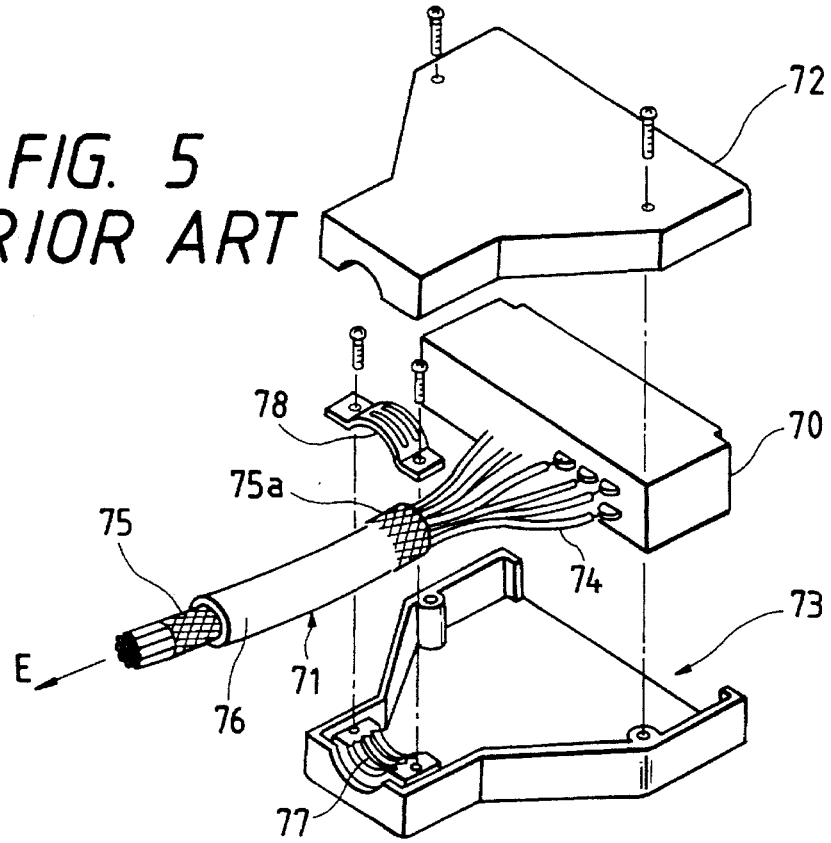
FIG. 5 PRIOR ART
FIG. 5 is a perspective view of a conventional shield connector, particularly illustrating essential components for the shield connector in the disassembled state.
Figure 6:
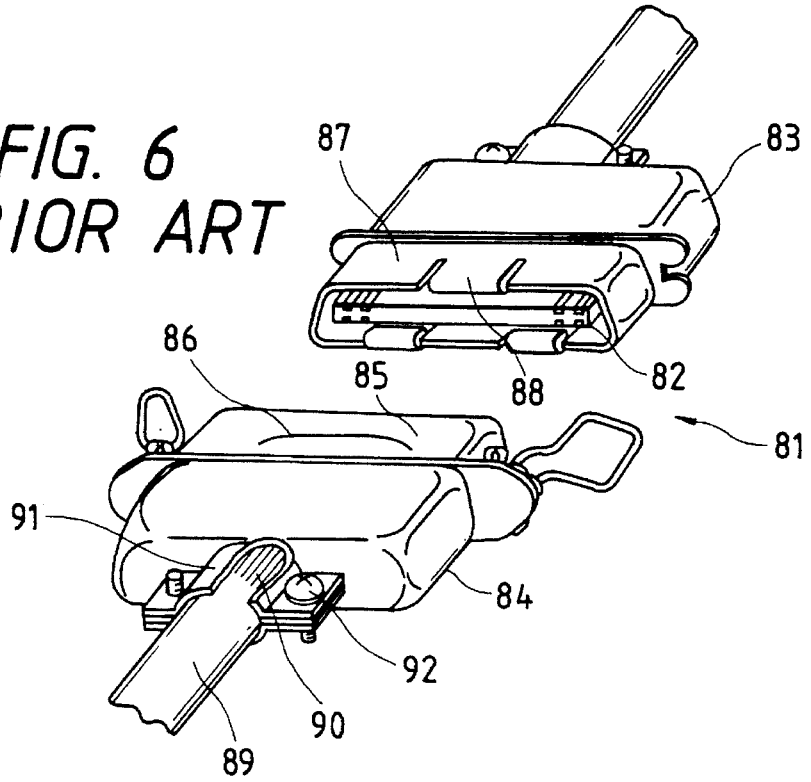
FIG. 6 PRIOR ART
FIG. 6 is a perspective view of another conventional shield connector, particularly illustrating essential components for the shield connector in the disassembled state.

FIG. 4 is a vertical sectional view of the shield connector constructed in the above-described manner, particularly showing the assembled state of the shield connector.

The tab-shaped connecting portions 63 of the grounding member 57 are soldered to the grounding base board 62, and an outer wall (lower wall) 64 of the female outer housing 50 having the grounding member 57 fitted thereinto is secured to the earthing base board 62. In addition, the upper male outer housing half 4 is fastened to the lower male outer housing half 5 by tightening the bolts 42, whereby it comes in close contact with the stabilizing plate 13 of the shield connecting member 3 having the unsheathed conductors 7 firmly held by binding. The grounding terminal 30 connected to the unsheathed conductors 7 is connected to one of the contact projections 56 projecting from the grounding member 57 in the lower terminal receiving chamber **32*b* of the inner housing 31**.

The male outer housing 29 is fitted into the female outer housing 50 so that they come in contact with each other along a fitting plane 65. To this end, a plurality of projections may be formed on the fitting plane 65 for contacting. In addition, the male and female outer housings 29 and 50 come in resilient contact with each other with the effect of the resilient locking member 45.

Since the shield connector is constructed in the above-described manner, contact points present within the range extending from the shield cable 1 to the grounding base board 62 are composed of a first contact point between the shield connecting member 3 connected to the unsheathed conductors 7 and the male outer housing 29, a second contact point in the form of the fitting contact plane 65 along which the male outer housing 29 and the female outer housing 50 come in contact with each other, a third contact point between the male and female outer housings 29 and 50 and the resilient locking member 45 and a fourth contact point between the earthing terminal 30 and one of the contact projections 56 of the earthing member 57.

With such construction, a first route (represented by an arrow mark B) extending from the unsheathed conductors 7 to the grounding base board 62 via the grounding terminal 30 and the grounding member 57, a second route (represented by an arrow mark C) extending from the shield connecting member 3 to the grounding base board 62 via the upper male outer housing half 4 and the resilient locking member 45, and a third route (represented by an arrow mark D) extending the lower male outer housing half 5 to the grounding base board 62 via the female outer housing 50 are built. As a result, the shield connector of the present invention achieves an excellent shielding property by achieving simultaneous grounding through many contact points and many grounding routes as mentioned above.

As is apparent from the above description, according to the present invention, the outer sheath of the shield cable is firmly held by a pair of binding pieces of the shield connecting member, and moreover, the engagement portions of the shield connecting member are brought in engagement with the engagement portion of the shield connector housing. Thus, there does not arise a malfunction that unsheathed conductors in the shield cable are dislocated away from the binding pieces of the shield connecting member when the shield cable is forcibly pulled in the rearward direction, resulting in stable electrical contact being reliably maintained.

In addition, since simultaneous grounding is achieved not only through many contact points but also through many grounding routes, the shield connector of the present invention can improve an earthing efficiency while behaving as an excellent shielding property.

What is claimed is:

1. A shield electrical connector which is mateable with a terminal member, comprising:

a plurality of first terminals for transmitting a signal;

a plurality of second terminals constituting grounding terminals;

a plurality of inner housings each for receiving said first and second terminals;

a plurality of first outer housings for respectively receiving said plurality of inner housings; and a second outer housing receiving said plurality of first outer housings and said plurality of inner housings, said plurality of first outer housings being engaged with said second outer housing, wherein substantially entire surfaces of said first and second outer housings are electrically conductive and wherein said second terminals are respectively electrically coupled to said electrically conductive surfaces of said first outer housings such that said second terminals can be grounded through said first and second outer housings.

2. The shield connector of claim 1, wherein said inner housing is molded of an electrical insulative material, and said inner housing is comprised with a plurality of chambers for receiving said first terminals thereinto, a chamber for receiving said second terminal therein, and a pair of projections for engaging with said first outer housing.

3. The shield connector of claim 1, wherein said first outer housing comprises an upper outer housing half and a lower outer housing half and divided into both said outer housing halves, and said first outer housing is molded of a resin material and completely plated with an electrical conductive material.

4. The shield connector of claim 1, further comprising a locking member locking said first and second outer housings, wherein said locking member is comprised with a V-shaped resilient member forming a contact portion for locking, wherein said locking member is placed on said first outer housing and an end portion of said locking member is engaged into said first outer housing.

5. The shield connector of claim 1, further comprising a grounding member comprising a plurality of contact projections made of an electrical conductive material for engaging with said second terminal, wherein said grounding member is fitted into said second outer housing.

6. The shield connector of claim 5, further comprising a molded terminal member, inserted into a front end of said second outer housing, having a plurality of third terminals integrally molded of a resin material for connecting to said first terminal in said inner housing.

7. The shield connector of claim 6, wherein said second outer housing is molded of a resin material and plated with an electrical conductive material, and said second outer housing comprises opening portions for inserting said grounding member and molded terminal member.

8. The shield connector of claim 3, wherein said first outer housing has a shield connecting member for electrically connecting said second terminal thereto.

9. A shield electrical connector connecting a shield cable including a plurality of sheathed cables, ground conductors and an outer sheath circumscribing said sheathed cables and said ground conductors, comprising:

a plurality of first terminals respectively connected to said sheathed cables for transmitting signals;

at least one second terminal connected to said ground conductors for grounding;

an upper outer housing half which is electrically conductive;

a lower outer housing half which is electrically conductive; and a shield connecting member held between said upper outer housing half and said lower outer housing half, and including first means for holding said outer sheath, second means for holding said sheathed cables and said ground conductors, and third means for retaining said shield connecting member to said lower outer housing half such that said upper outer housing half and said lower outer housing half act as electrical conductive paths for grounding said at least one second conductor.

10. The shield connector of claim 9, wherein said first means comprises a pair of first binding pieces for holding said shield cable via said outer sheath by binding.

11. The shield connector of claim 9, wherein said second means comprises a pair of second binding pieces for holding said sheathed cables and unsheathed conductors by binding.

12. The shield connector of claim 9, wherein said third means comprises a pair of engagement portions insertable into said lower outer housing half and stably contacting a surface thereof.

13. The shield connector of claim 9, wherein said upper and lower outer housing halves are integrated by tightening bolts while holding said shield connecting member therebetween.

* * * * *